US011492806B2

(12) United States Patent
Jones

(10) Patent No.: US 11,492,806 B2
(45) Date of Patent: Nov. 8, 2022

(54) ROOF FLASHING OVERLAY SYSTEM

(71) Applicant: Timothy N Jones, Granite Bay, CA (US)

(72) Inventor: Timothy N Jones, Granite Bay, CA (US)

( * ) Notice: Subject to any disclaimer, the term of this patent is extended or adjusted under 35 U.S.C. 154(b) by 197 days.

(21) Appl. No.: 16/808,064

(22) Filed: Mar. 3, 2020

(65) Prior Publication Data

US 2020/0284036 A1 Sep. 10, 2020

Related U.S. Application Data

(60) Provisional application No. 62/813,613, filed on Mar. 4, 2019.

(51) Int. Cl.
*E04D 13/00* (2006.01)
*E04D 13/04* (2006.01)

(52) U.S. Cl.
CPC .. *E04D 13/0445* (2013.01); *E04D 2013/0454* (2013.01)

(58) Field of Classification Search
CPC ..... E04D 2013/0454; E04D 13/0445
See application file for complete search history.

(56) References Cited

U.S. PATENT DOCUMENTS 3,735,540 A * 5/1973 Thaler ..... E04D 13/155 52/96
3,738,068 A * 6/1973 Attaway ..... E04D 13/155 52/60
4,332,117 A * 6/1982 Quinnell ..... E04D 13/1585 52/94
4,677,248 A * 6/1987 Lacey ..... F24S 25/65 136/246
5,388,379 A * 2/1995 Lamberti ..... E04D 13/15 52/468
6,182,400 B1 * 2/2001 Freiborg ..... E04D 1/30 52/518
6,725,617 B2 * 4/2004 Cox ..... E04B 5/10 52/96
6,820,376 B2 * 11/2004 Morphet ..... E04D 3/08 52/96
7,765,743 B2 * 8/2010 Guilford ..... E04D 13/0643 52/12

(Continued)

*Primary Examiner* — Basil S Katcheves
(74) *Attorney, Agent, or Firm* — Cynthia S. Lamon; Lamon Patent Services

(57) ABSTRACT

A flashing overlay system for overlaying roofing materials occupying a roof valley includes multiple planar flashing units having at least one first non-planar feature, the flashing units arranged in pairs including a left flashing unit and a right flashing unit, the flashing unit pairs covering the roofing materials occupying the roof valley along the length and track of the roof valley, the paired flashing units abutted together along the edges of the planar material supporting the at least one first non-planar feature, the first non-planar features aligned generally with the center line of the roof valley. The units are tired together with at least one elongated saddle strip folded over at longitudinal center and clamped over, fastened over, or otherwise fitted over the abutted first non-planar features of the multiple planar flashing units paired together and overlaying the roofing materials occupying the roof valley.

9 Claims, 4 Drawing Sheets

(56) References Cited

U.S. PATENT DOCUMENTS

| | | | | |
|---|---|---|---|---|
| 8,205,396 | B2 * | 6/2012 | Atiyeh, Sr. | E04D 13/155 52/60 |
| D672,057 | S * | 12/2012 | Yoder | D25/61 |
| D672,477 | S * | 12/2012 | Yoder | D25/61 |
| D672,883 | S * | 12/2012 | Yoder | D25/61 |
| D672,884 | S * | 12/2012 | Yoder | D25/61 |
| D672,885 | S * | 12/2012 | Yoder | D25/61 |
| 8,739,470 | B1 * | 6/2014 | Wayne | E04D 13/15 52/96 |
| 8,869,466 | B2 * | 10/2014 | Garcia | E04F 19/00 52/60 |
| 9,115,497 | B2 * | 8/2015 | Morris | E04D 13/0767 |
| 10,077,557 | B2 * | 9/2018 | Joly | E04D 13/0643 |
| 10,305,417 | B1 * | 5/2019 | Tanghongs | H02S 20/23 |
| 10,352,048 | B2 * | 7/2019 | Pendley | E04D 3/30 |
| 10,640,982 | B1 * | 5/2020 | Bulla | E04D 13/068 |
| 10,808,406 | B2 * | 10/2020 | Folkersen | E04D 13/158 |
| 11,035,124 | B2 * | 6/2021 | Baldassi | E04D 13/0643 |
| 2003/0159379 | A1 * | 8/2003 | Pickler | E04D 13/0459 52/283 |
| 2006/0053699 | A1 * | 3/2006 | Lolley | E04B 1/66 52/58 |
| 2007/0266657 | A1 * | 11/2007 | Gembala | E04D 13/15 52/288.1 |
| 2009/0107053 | A1 * | 4/2009 | Guilford | E04D 13/0643 52/12 |
| 2011/0041429 | A1 * | 2/2011 | Rummens | F24S 25/16 52/302.1 |
| 2018/0179761 | A1 * | 6/2018 | Higginbotham | E04D 13/076 |
| 2018/0223537 | A1 * | 8/2018 | Bredeweg | E04D 13/158 |
| 2018/0347197 | A1 * | 12/2018 | Folkersen | E04D 13/158 |
| 2019/0284810 | A1 * | 9/2019 | Folkersen | E04D 13/158 |

* cited by examiner

ROOF FLASHING OVERLAY SYSTEM

CROSS-REFERENCE TO RELATED DOCUMENTS

The present application claims priority to a provisional patent application No. 63/813,613, filed on Mar. 4, 2019 entitled Debris Flashing Especially for Tile Roofs, disclosure of which is included herein at least be reference.

BACKGROUND OF THE INVENTION

1. Field of the Invention

The present invention is in the field of construction materials including roofing materials and pertains particularly to methods and apparatus for protecting a roof valley from debris.

2. Discussion of the State of the Art

In the roofing construction trades, roofing materials generally include some form of flexible underlay layer of protective covering beneath shingles or tiles or other primary roof coverings. specialty flashing is typically utilized to further protect underlying structural portions of the roof from moisture. One common form of roofing system is the flat tile roof. A flat tile is often made of a material like a cement formed into tiles. Tiles may also be made of fired clay material or a variety of other materials. Such flat tile roofs are typically thicker than slate shingles and asphalt shingles.

The greater thickness dimensions of tiles can be problematic at the valley locations on a roof. For example, the way tiles are laid, upper tiles over lower tiles, creates a gap space beneath the upper tile and lower tile where debris may be blown in and become lodged. At the valley locations, tiles are typically cut so that the tiles can come close to the valley and overlie valley flashing, which is often referred to in the art as a ribbed valley. The relatively large gap space under the flat tiles is accessible to debris entering laterally as these tiles terminate at the valley flashing.

Typical flashing material provides an extra layer of protection between the tile under-surface and the wood however, in a tile ribbed valley, water and debris may be blown into the gap spaces. Leaving such debris lodged beneath the tiles invites further debris clogging and eventual passage of the debris past the flashing edge leaving only the roof flexible sheet overlay as a last barrier between the debris and raw wood material of the roof. The problem is expounded in roof structures with relative low pitches.

To avoid the problem of debris collection under valley roof tiles, periodic maintenance is required. It is known in the prior art to fight against this problem with flat tile roof by following techniques like periodic removal of tiles adjacent to the valleys in the roof and manually cleaning out any debris which has collected within these gaps. While generally effective, this is a complex procedure, and it is hard to determine whether such a procedure is necessary or not, and how often it should be performed since the gaps cannot be easily studied to determine how full they are of debris. Furthermore, repeated cleaning cycles performed on a roof may cause damage over time to the roof underlay material and the tiles themselves.

Therefore, what is clearly needed is a flashing component that restricts or blocks debris access into gaps left between over laid roof tiles.

BRIEF SUMMARY OF THE INVENTION

Accordingly, a flashing overlay system for overlaying roofing materials occupying a roof valley is provided and includes multiple planar flashing units having at least one first non-planar feature, the flashing units arranged in pairs including a left flashing unit and a right flashing unit, the flashing unit pairs covering the roofing materials occupying the roof valley along the length and track of the roof valley, the paired flashing units abutted together along the edges of the planar material supporting the at least one first non-planar feature, the first non-planar features aligned generally with the center line of the roof valley, the left flashing units disposed left of center and the right flashing units disposed right of center, and at least one elongated saddle strip folded over at longitudinal center and clamped over, fastened over, or otherwise fitted over the abutted first non-planar features of the multiple planar flashing units paired together and overlaying the roofing materials occupying the roof valley.

In one embodiment, the flashing units are metallic sheets of aluminum or galvanized steel. In another embodiment, the flashing units are polymeric sheets rated for protection against ultraviolet radiation. In one embodiment, the roofing materials covered by the flashing system are roofing tiles. In a preferred embodiment, the multiple flashing units each include a second non-planar feature having a three side box structure contiguously formed therefrom or formed separately and pivotally attached thereto, the second non-planar feature disposed proximal to the bottom edge of each flashing unit in correct overlay orientation, the open end of the box structures fitted over or clamped over the lower edge or edges of the roofing materials overlaid by the flashing units.

Accordingly, a flashing overlay system is provided. This system includes a first edge of the planar material, the first edge including a rib feature formed orthogonally to the planar surface and extending upward from the planar surface, the feature formed substantially along the length of the first edge, a second edge of the planar material extending substantially laterally from the top end of the first edge, a third edge of the planar material extending substantially downward and toward the bottom end of the first edge of the planar material, and a fourth edge of the planar material, the fourth edge substantially shorter in length than the first, second, or third edges, the fourth edge substantially parallel with the second edge and bridging the bottom of the third edge to the bottom of the first edge, the fourth edge including a wind clip anchoring feature pivotally attached to the fourth edge or contiguously formed off of the fourth edge.

In one embodiment, the planar flashing unit functions as a left-side flashing unit in a pair of flashing units arranged adjacently over a roof valley. In this embodiment there is a planer flashing unit functioning as a right-side flashing unit in a pair of flashing units arranged adjacently over a roof valley. In a variation of this embodiment, the rib feature along the first edge tapers down in height from the proximity of the top end of the first edge to the proximity of the bottom end of the first edge.

In one embodiment, the flashing unit further includes a pair of vertically aligned through openings placed through the planar material of the flashing unit for accepting fasteners, the top opening proximal to the second edge and the bottom opening proximal to the fourth edge, wherein an invisible vertical center line running through the openings is substantially perpendicular to the fourth edge. In one embodiment, the rib feature includes one or more snap pin recesses distributed on the internally facing side of the rib feature adapted to accept snap pins on the overlaying wall of a saddle strip.

In one embodiment of the flashing overlay system, the elongated saddle strip cover comprises a single sheet of flashing material custom cut to length equal to or just greater than the length of the roof valley taken along the center line of the roof valley, the flashing material creased or folded over along longitudinal center to form the saddle configuration to cover the rib features of the flashing units. In another embodiment of the flashing overlay system, the elongated saddle strip cover is shorter in length than the roof valley requiring more than one saddle strip cover to cover the overall length of the rib features. In a preferred embodiment of the flashing overlay system, the first non-planar features aligned generally with the center line of the roof valley abut at left and right rib features, wherein the rib features are clamped, snapped together, or otherwise fastened together beneath the saddle strip cover.

DETAILED DESCRIPTION OF THE INVENTION

In various embodiments described in enabling detail herein, the inventor provides a unique flashing system comprised of unique left and right flashing units tied together to cover and protect the underlying gap spaces under overlaying roofing materials installed in a roof valley from receiving laterally directed wind-blown debris and water. The present invention is described using the following examples, which may describe more than one relevant embodiment falling within the scope of the invention.

It is a goal of the present invention to provide a protective tile flashing overlay system of individual flashing units that are configured to be placed over relatively flat tiles adjacent to a valley in the roof. Another goal of the present invention is to provide a flashing overlay system that effectively prevents laterally driven debris from entering gap space between upper and lower tiles. It is a further goal of the present invention to provide a flashing overlay system that reduces or eliminates the periodic requirement of tile removal and replacement to access debris clogs beneath the tiles.

Figure 1:
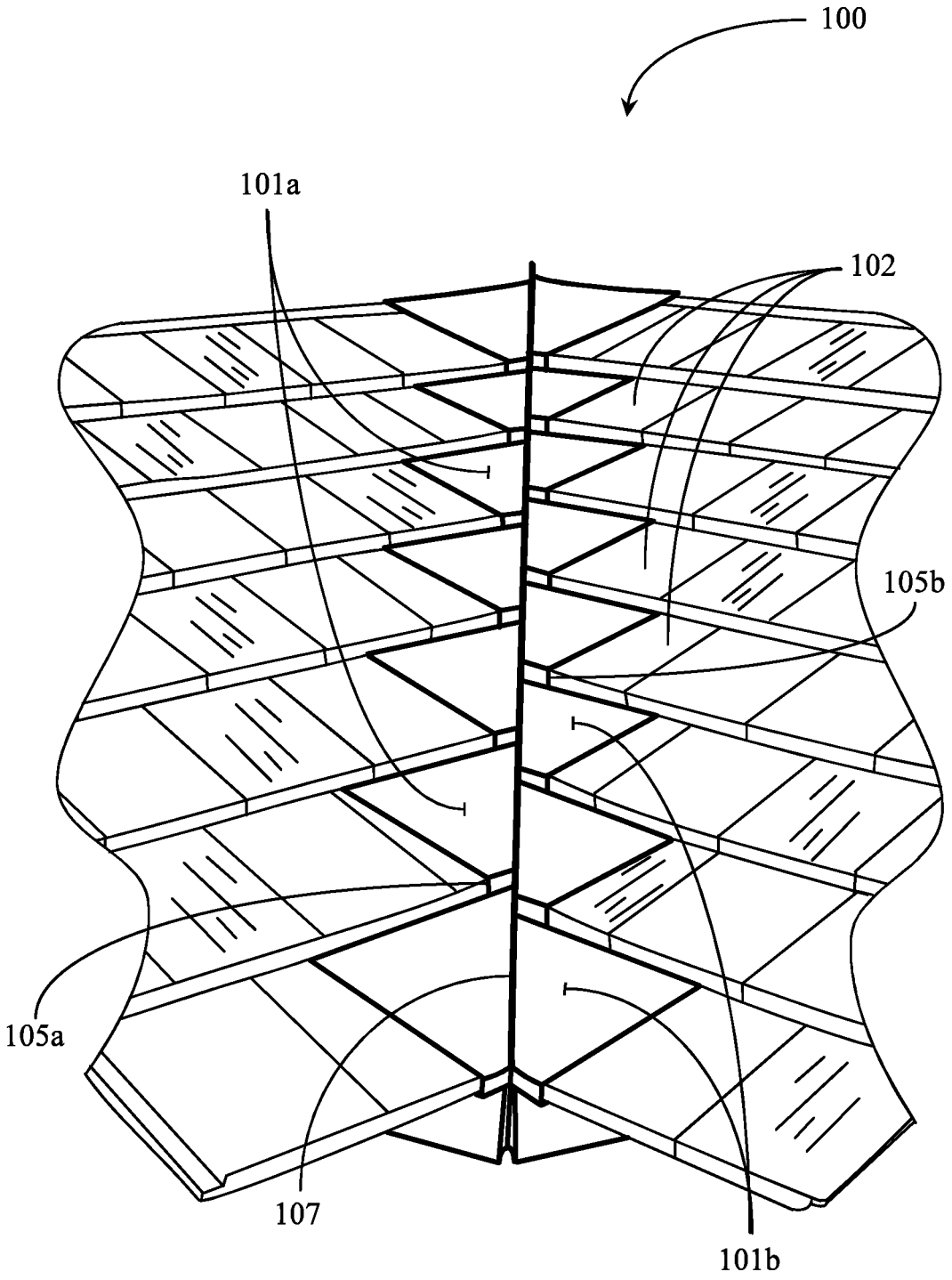
FIG. 1 is a partial elevation view of a tile roof structure supporting a valley flashing system according to an embodiment of the present invention.

FIG. 1 is a partial elevation view of a tile roof structure supporting a valley flashing system 100 according to an embodiment of the present invention. Valley flashing system 100 may be configured from individual right-side valley flashing units 101*a*, and individual left-side valley flashing units 101*b*. In this embodiment, the roofing structure comprises a tile roof and may include an underlay of protective roofing paper or sheet material (not visible), tiles 102 arranged in staggered rows and offset edges for proper roof drainage purposes.

In this embodiment, valley flashing units 101*a* and 101*b* are mirror imaged parts (left, right) having non-planner features oriented in a same direction to produce a left valley flashing unit and a right valley flashing unit. A single valley flashing unit 101*a* or 101*b* may be fabricated from aluminum sheet or stainless or galvanized steel sheet materials typically used for roof flashing. In one embodiment, valley flashing units 101*a* and 101*b* may be fabricated of a durable and weather resistant polymeric material, hydrocarbon material, or composite materials thereof, the polymeric material having a sufficient UV (ultra violet radiation) protection rating against sun damage and, if required, a heat/cold coefficient factor for polymeric roof materials. In the case of metallic material use, valley flashing units 101*a* and 101*b* may be left plain or without finish, painted or coated, or otherwise powder coated, sand blasted, etc.

Valley flashing units 101*a* and 101*b* include at least two non-planer features. Valley flashing units 101*a* and 101*b* are substantially triangular parts in profile, the units including a short fourth side or edge defining one of the non-planer features formed at one of the corners. Valley flashing units 101*a* and 101*b* include at least two non-planer features. For example, one edge of a valley flashing unit 101*a* or 101*b* (mirror image) is formed or bent upward along the edge to create a rib feature extending at least relatively orthogonally upward from the triangular plane of the unit. This feature allows left and right units to be laid side-by-side over the tiles 102 where the orthogonally extending ribs meet substantially at the center of the valley. Valley flashing system 100 includes a flashing system saddle strip cover 107 that is configured to fit over the adjacent and interfacing rib features on the valley flashing units interfacing edges, effectively tying the valley flashing units together.

Another non-planer feature of valley flashing units 101*a* and 101*b* is in the form of a wind clip structure, which may be provided at a lowermost corner relative to orientation of the units in a roof valley. The wind clip structure is strategically located at the lower corner of valley flashing units 101*a* and 101*b*. The wind clip structure is adapted by bending or forming to fit over the lower edge of a tile 102 being covered. This non-planar feature may exhibit a three-sided box like cross-section in side-elevation profile, the feature extending downward to cover the thickness of the tile and then rearward to fit underneath the tile being covered.

In one embodiment, the wind clip feature is provided as a separate component riveted to or otherwise rotably attached to the flashing unit so that it may pivot somewhat relative to the rest of the valley flashing unit. A wind clip fits over the lower edge of the tile being covered and provides an anchor point for keeping the valley flashing unit from bowing upward or flapping due to strong winds. The wind clip feature has an inside diameter just larger than or equal to a thickness dimension of the lower edges of the flat tiles to be covered by the flashing product. Preferably, the lowermost corner of the flashing product is truncated so that this corner defines a very short fourth side of the main triangular planar surface of the flashing product. This short fourth side is typically about 1.5 to 2.0 inches in length. The wind clip preferably has a similar length as this short fourth leg at the truncated lower corner of the flashing unit 101*a* or 101*b*.

Figure 2A:
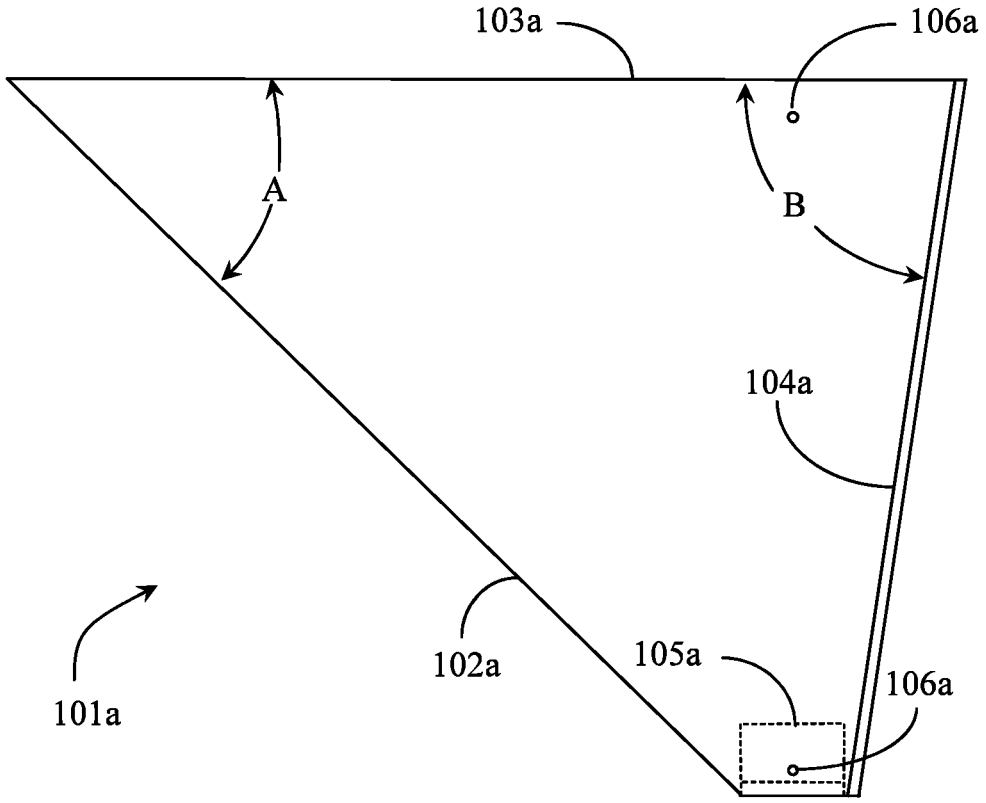
FIG. 2A is an overhead view of a valley flashing unit of the valley flashing system of FIG. 1.

FIG. 2A is an overhead view of a valley flashing unit 101*a* of the valley flashing system of FIG. 1. Valley flashing unit 101*a* includes a planar triangular profile with a short fourth side formed at the lowest corner as a result of the previously described wind clip non-planar feature 105*a*. Flashing unit 101*a* includes an edge that is formed into a substantially orthogonal rib feature 104*a*. Rib feature 104*a* is a non-planar feature formed such as by stamping or form bending the edge along a bend line drawn inside of and roughly parallel to the edge line of the unit. Rib feature 104*a* occupies rough center of the roof valley given a reasonable tolerance and aligns with an identical feature 104*b* on a right-side flashing unit 101*b* so that left and right flashing units may be tied or otherwise held together along this feature. The overall thickness dimension of the material used for the flashing units may be typical standard thicknesses for flashing materials used to protect valleys and other roof areas requiring flashing materials. Thin sheet material of about one thirty-second to one sixteenth of an inch may be typical.

In this view, a top edge 103*a* extends laterally to the left of rib feature 104*a* forming an acute angle B with the edge supporting orthogonal rib feature 104*a*. Angle B may be about 80 degrees but may be smaller than 80 degrees or as large as a right angle or up to 90 degrees without departing from the spirit and scope of the present invention. Edge 103*a* is the top lateral edge of the valley flashing units 101*a* and 101*b* of FIG. 1. In FIG. 1 the top left flashing unit 101*a* depicts the top edge of the unit given the element number 103*a* in this view. For the lower units, the top lateral edge extends beneath the lower edges of the upper adjacent row of tiles.

A third edge 102*a* of valley flashing unit 101*a* forms an acute angle A of about 45 degrees from the end of edge 103*a* and edge 102*a* extends downward and toward the lower end of rib feature 104*a*. In this embodiment, rib feature 104*a* extends upward orthogonally from the generally triangular flat plane of the flashing unit. Wind clip feature 105*a* may be a separate component attached to valley flashing unit 101*a* or it may be cut and then formed at the lower corner end of the unit as is depicted in this embodiment. Wind clip feature 105*a* presents on the side opposite of the orthogonal rib feature 104*a*. The wind clip feature is substantially shorter than other sides of the flashing unit. The fourth short truncated edge of the triangular profile of valley flashing unit 101*a* may be about one- and one-half inches or two inches long. In one embodiment the fourth short truncated edge supporting the wind clip feature 105*a* may be roughly parallel to edge 103*a*.

In this embodiment, edge rib feature 104*a* may be about 19 inches in length. In this embodiment, the laterally extended edge 103*a* may be about 22 inches in length, and the longest edge 102*a* may be about 26 inches in length. In one embodiment, larger flashing units may be provided having larger overall dimensions. Likewise, smaller units may be created having smaller overall dimensions than those depicted in this example. In one embodiment, valley flashing unit 101*a* is laid on the left side of a roof valley over the left-of-center tiles as depicted in FIG. 1 of this specification. The right-side valley flashing units 101*b* laid on the right-side of the roof valley center line. The rib features of the left and right parts abut against one another and may be covered by an elongated saddle strip that protects a gap between the parts from water and debris infiltration.

In one embodiment, openings 106*a* may be provided through the planar portion of the material to accept fasteners though it is not required to practice the invention. The flashing system may be otherwise secured to the roof tiles by the weight of the tiles acting on the underlying top lateral edges of a flashing unit, by the wind clip features tucked under the lower tile edges of the covered tiles, and by the saddle strip connecting the mirrored flashing units at the center-line of the roofing valley.

Figure 2B:
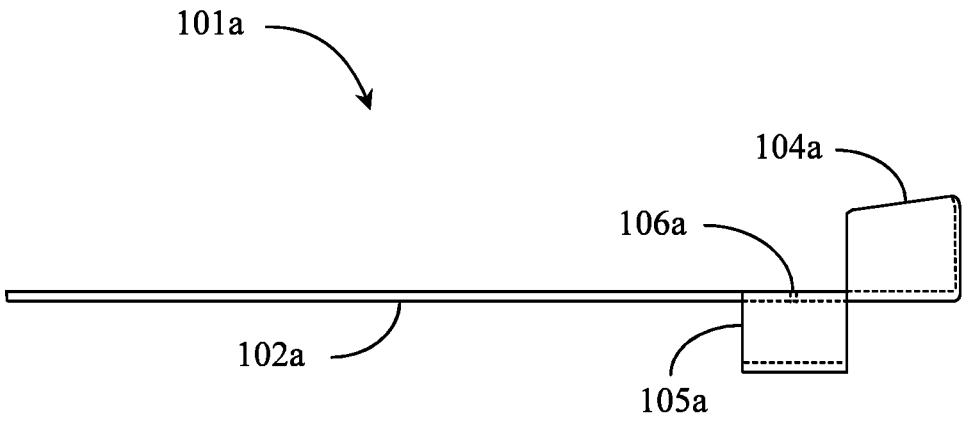
FIG. 2B is a front-elevation view of the valley flashing unit of FIG. 2A.

FIG. 2B is a front-elevation view of the valley flashing unit 101*a* of FIG. 2A. In this view, edge 102*a* is planar and visible. It is assumed that this front-elevation view taken in line from the overhead view of FIG. 2A depicts the lower end of the valley flashing unit 101*a* as oriented on a roof valley. Wind clip feature 105*a* is viewed straight on in this angle and is depicted horizontally. Edges of valley flashing unit 101*a* may have burrs removed or otherwise may be filed or rounded to remove sharp edges. In one embodiment, rib feature 104*a* has a tapered down height dimension wherein the height of feature 104*a* is the largest at the top end of the rib feature in correct roof orientation and tapers down gradually to the lower end adjacent to wind clip 105*a*. In one embodiment, the height of the rib feature 104*a* is uniform along the length of the feature.

The orthogonal height of rib feature 104*a* may be at least one and a quarter inch in height at the lowest end (if tapered) and up two a few inches in height at the upper end of the rib feature 104*a*. In one embodiment, rib feature 104*a* is uniform in height along the length and provides enough orthogonal material to define an interfacing wall with enough height to accept a saddle strip placed there over like saddle strip cover 107 described in FIG. 1 above. More detail about tying the valley flashing units together as a system analogous with valley flashing system 100 of FIG. 1 is detailed later in this specification.

Figure 2C:
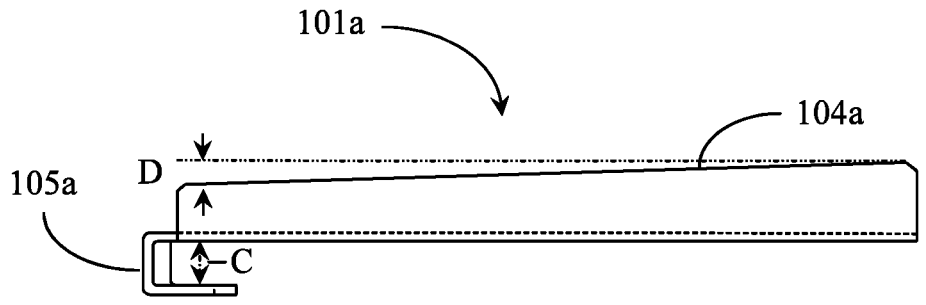
FIG. 2C is a side-elevation view of the valley flashing unit of FIG. 2A.

FIG. 2C is a right-side-elevation view of valley flashing unit 101*a* of FIG. 2A. Orthogonal rib feature 104*a* extends from the upper most corner of flashing unit 101*a* relative to roof orientation, down to the wind clip feature 105*a*. Rib feature 104*a* is viewed straight on in the view and has a uniform taper down the length of the feature causing angle D. Angle D may be about 4 degrees. In one embodiment, rib feature 104*a* is of a uniform height across the length of the feature. In this example, rib feature 104*a* is rounded or chamfered at the corner ends to remove sharp edges.

In one embodiment, rib feature 104*a* may be shorter than the length of the side of the flashing unit supporting it such as by being cut down at an angle to the surface of the flashing unit. For example, equal length angle cuts may be provided at both ends of the rib feature that extend down at an angle such as 45 degrees for example to the flat planner material of the flashing unit. The previously described saddle strip cover 107 of valley flashing system 100 of FIG. 1 protects the tops of two adjacent rib features (left and right flashing units laid adjacent in valley) from water or debris entering through the minute gap between the pieces and ties multiple mirrored pairs of the valley flashing units 101*a* and 101*b* together forming a covered central spine occupying and tracking the general center-line of the roof valley.

In this view, wind clip feature 105*a* presents beneath the planar material of the flashing unit as a three-sided box open toward the upper end of the flashing unit relative to roof valley orientation. Wind clip feature 105*a* has an inside diameter C that is the same as or just larger than the thickness of the lower edge of the tile flashing unit 105*a* is covering. In one embodiment, wind clip feature 105*a* is a separate component that is attached to the planar material of flashing unit 101*a* in a manner enabling the wind clip to pivot somewhat about the point of attachment. In one embodiment, wind clip feature 105*a* may be adapted as a spring clamp that anchors each flashing unit to the tile it covers.

Figure 2D:
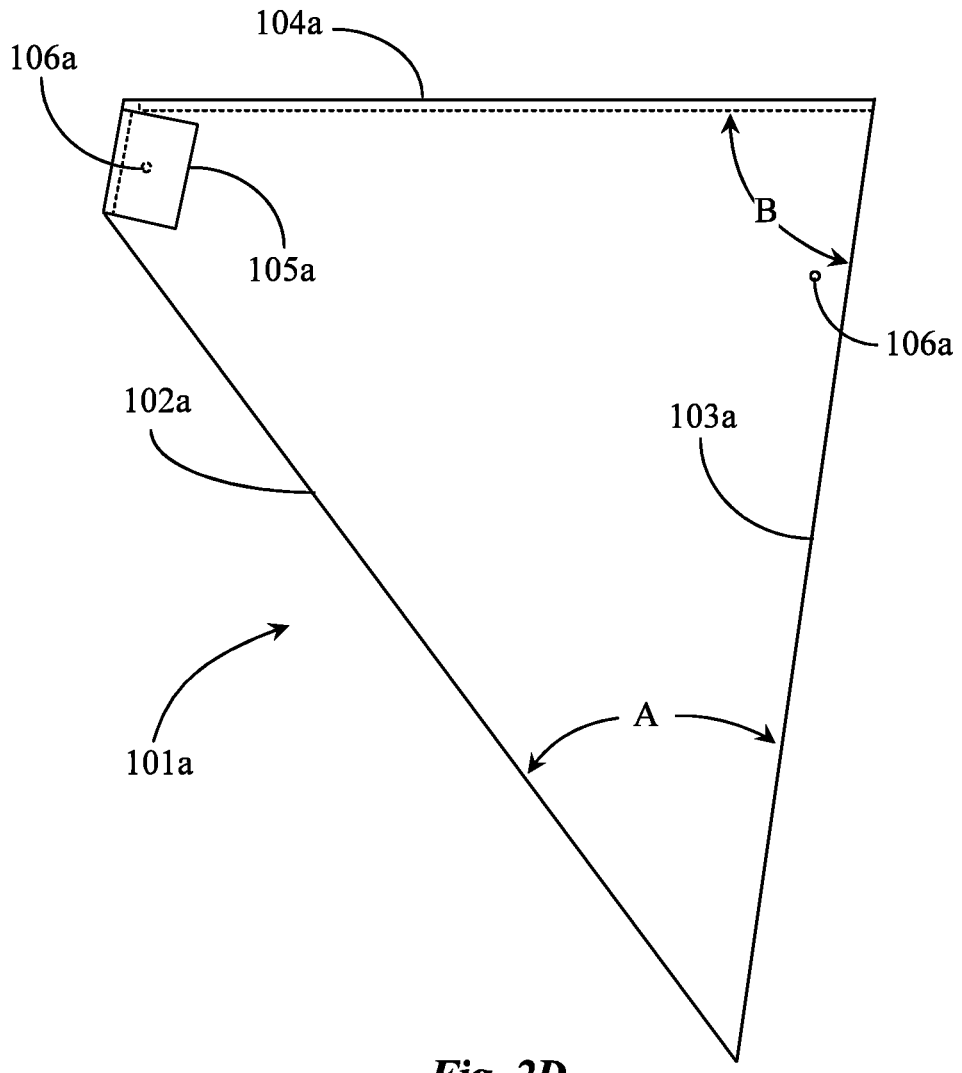
FIG. 2D is an underside view of the valley flashing unit of FIG. 2A.

FIG. 2D is an underside view of valley flashing unit 105*a* of FIG. 2A. In this view, valley flashing unit 105*a* is rotated down along an axis defining the rib feature edge as viewed in FIG. 2C to depict the underside of the unit. The underside of the planar material lies on top of a tile or set of adjacent cut tiles laid on one side of a roof valley over standard bottom flashing materials provided beneath the tiles and on top of any roof under-laminate material covering roof boards. Wind clip feature 105*a* clips over the lower edge of the covered tile. Rib feature 104*a* extends orthogonally upward from the top side of the planar surface of valley flashing unit 101*a*.

Side 103*a* of flashing unit 101*a* extends laterally away from the top of the rib feature 104*a* wherein side 103*a* is the top edge of the flashing unit in roof valley orientation. This top edge has a 9-degree taper or there about off a 90-degree angle from the top end of the rib feature. Angle B may be approximately 81 degrees. Top edge 103*a* is tucked under the bottom edge an upper adjacent tile or tile set. The very top valley flashing unit 101*a* has side 103*a* tucked under a roofing ridge-cap or another flashing strip if the valley terminates before the ridge line of the roof so the top edge 103*a* is never left exposed.

Openings 106*a* may be provided for fasteners but are not required to practice the invention or to secure a valley flashing system like system 100 of FIG. 1 over the tiles laid adjacent to the roof valley. Side 101*a* connects to side 103*a* at an angle A at approximately 54 degrees, leaving approximately a 45-degree angle between the rib feature 104*a* and side 102*a* at the proximity of wind clip structure 105*a*.

Figure 3A:
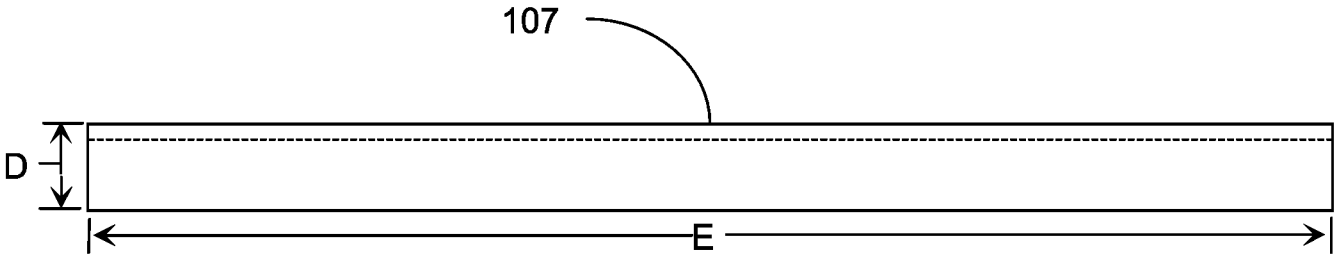
FIG. 3A is a side-elevation view of a valley flashing system cover strip.

FIG. 3A is a side-elevation view of a valley flashing system saddle strip cover 107. Saddle strip cover 107 may be manufactured from the same materials as the flashing units 101*a* and 101*b* (see FIG. 1). Saddle strip cover 107 may be an elongated contiguous strip of material that has been folded over or otherwise formed about longitudinal center to produce a tie in cover piece long enough to cover multiple mirrored pairs of flashing units making up the valley length, or one piece to cover the valley rib features of the units at substantial center of the roof valley.

Saddle strip cover 107 may have a standard cut length E representing a factory length that may be trucked and conveyed to a roof top along with other roofing materials. In one embodiment, saddle strip cover 107 may be provided in material rolls and may be cut and formed as needed in custom lengths that may be desired. Saddle strip cover 107 has an overall height D of approximately one and one-quarter of an inch. The broken line is intended to represent thickness of the saddle strip cover material, which may be identical in thickness to the planar flashing material of flashing units 101*a* and 101*b*. A flat strip before center folding may be up to two and one-half inches wide. However, dimensions may vary according to the actual materials used in a roof valley installation.

In one embodiment, a valley may be longer than a standard length of saddle strip cover 107. In such a case more than one saddle strip may be linearly installed starting from the lower end of the valley and working up. In the case of multiple saddle strips for a single valley flashing system like system 100 of FIG. 1, a lowest strip may be installed and then a next saddle strip, the lower edge thereof overlaid over the top edge of the previously laid strip. In one embodiment where roof valleys exist on opposite sides of a roof ridge line, two valley flashing systems may be tied over the top by an angular cap piece (not illustrated) that may fit over the top ends of the installed saddle strip covers 107, the cap piece extended in length to cover each top end of the saddle strip cover covers. In one embodiment, individual cap pieces (not illustrated) may be provided to cover any gaps at the top ends of the saddle strip covers after installation.

Figure 3B:
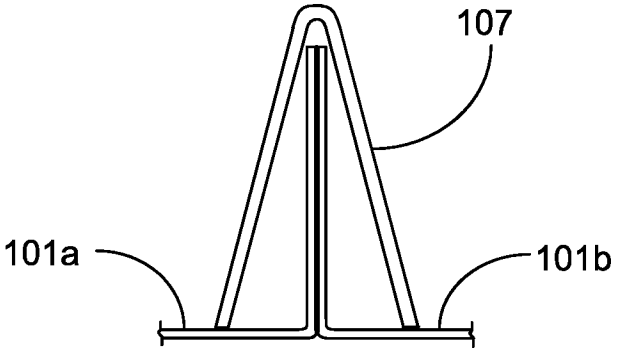
FIG. 3B is a front-elevation view of the valley flashing system cover strip of FIG. 3B fitted over right side and left side valley flashing units where those units make interface.

FIG. 3B is a front-elevation view of the valley flashing system saddle strip cover 107 of FIG. 3B fitted over right side and left side valley flashing units where those units make interface. In this view, it is assumed a front-elevation is an elevation view of saddle strip cover 107 at the lowest point on the valley flashing system. In this embodiment, saddle strip cover 107 is creased over longitudinal center of the sheet material creating a shroud like structure covering the top edges of the interfacing rib features of flashing unit 101*a* and flashing unit 101*b*.

The gap between the opposing walls at the bottom of the strip may be about one-quarter of an inch. This gap may in actual practice be larger or smaller without departing from the spirit and scope of the invention. In one embodiment, the side walls of saddle strip cover 107 are not straight but curved in or pinched over at least the top one half of the height of the adjacent rib features of the flashing units. In another embodiment, the side walls of a saddle strip might be adapted to snap over or otherwise enabled to be fastened to or through the adjacent rib features firmly holding the rib features together in a manner that does not affect the function of strip cover 107 of preventing moisture or debris from entering through the gap between adjacent rib features. For example, the rib features may include one or more snap pin recesses distributed on the internally facing side of the rib features, the recesses adapted to accept snap pins protruding orthogonally from the overlaying inside interfacing wall of a saddle strip in saddle configuration.

Also, in one embodiment, adjacent rib features may be fastened to one another to firmly tie two valley flashing units together firmly, where the saddle strip cover 107 is also fastened to the rib features, or not fastened to the rib features. It is noted herein that when structures of the invention are identified as being coupled together or tied together, such language should be interpreted broadly to include the structures being coupled directly together or coupled together through intervening structures. Such coupling may be permanent or temporary depending on the type of fastener system employed. Such coupling may be affected in a rigid fashion or in a flexible fashion which allows pivoting, sliding or other relative motion of parts in the system while still providing some form of anchor attachment.

It will be apparent to the skilled person that the arrangement of elements and functionality for the invention is described in different embodiments in which each is exemplary of an implementation of the invention. These exemplary descriptions do not preclude other implementations and use cases not described in detail. The Uses and methods depicted within this description are purely emblematic of definitive ways in which to build and operate this invention and are not to be understood to be limiting of scope in any way. While the uses and methods have been described with a certain degree of particularity, it is to be noted that many alterations could be made in the details of the construction and the arrangement of the apparatus and its components without departing from the spirit and scope of this invention. It is implied that the uses and methods are not limited to the examples represented in this specification for the purpose of clarification and persuasion. The invention is limited only by the breadth of the claims below.

The invention claimed is:

1. A substantially planar flashing unit of a flashing overlay system comprising:

a planar surface, the planar surface having a substantially triangular profile;

a first edge of the planar surface having a bottom end, a top end, a length, and a rib feature formed orthogonally to the planar surface and extending upward from the planar surface, the feature formed substantially along the length of the first edge;

a second edge of the planar surface, the second edge having a length a third edge of the planar surface, the third edge having a bottom end, a top end, and a length; and a fourth edge of the planar surface, the fourth edge having a length and a wind clip anchoring feature, the length of the forth edge substantially shorter than the lengths of the first, second, and third edges, the fourth edge substantially parallel with the second edge and the wind clip anchoring feature pivotally attached to the fourth edge;

wherein the second edge extends from the top end of the first edge to the top end of the third edge, the fourth edge extends from the bottom end of the first edge to the bottom end of the third edge.

2. The planar flashing unit of claim 1 functioning as a left-side flashing unit in a pair of flashing units arranged adjacently over a roof valley.

3. The planar flashing unit of claim 2, wherein the rib feature along the first edge tapers down in height from the proximity of the top end of the first edge to the proximity of the bottom end of the first edge.

4. The planar flashing unit of claim 2, wherein the rib feature includes one or more snap pin recesses distributed on the internally facing side of the rib feature adapted to accept snap pins on the overlaying wall of a saddle strip.

5. The flashing overlay system of claim 4, wherein the elongated saddle strip cover is shorter in length than the roof valley requiring more than one saddle strip cover to cover the overall length of the rib features.

6. The planar flashing unit of claim 1 functioning as a right-side flashing unit in a pair of flashing units arranged adjacently over a roof valley.

7. The planar flashing unit of claim 1, wherein the rib feature along the first edge tapers down in height from the proximity of the top end of the first edge to the proximity of the bottom end of the first edge.

8. The planar flashing unit of claim 1, further including a pair of vertically aligned through openings placed through the planar material of the flashing unit for accepting fasteners, the top opening proximal to the second edge and the bottom opening proximal to the fourth edge, wherein an invisible vertical center line running through the openings is substantially perpendicular to the fourth edge.

9. The planar flashing unit of claim 1, wherein the rib feature includes one or more snap pin recesses distributed on the internally facing side of the rib feature adapted to accept snap pins on the overlaying wall of a saddle strip.

* * * * *